United States Patent [19]

Ayers

[11] Patent Number: 4,881,738

[45] Date of Patent: Nov. 21, 1989

[54] MANIPULATIVE AMUSEMENT DEVICE

[76] Inventor: David B. Ayers, 13908 Cravenridge Dr., Houston, Tex. 77083

[21] Appl. No.: 295,819

[22] Filed: Jan. 11, 1989

[51] Int. Cl.[4] ..... A63F 9/08

[52] U.S. Cl. ..... 273/153 S; 273/155

[58] Field of Search ..... 273/153 S, 155

[56] References Cited

U.S. PATENT DOCUMENTS 4.377,916 3/1983 Komiya ..... 273/153 S X
4,708,345 11/1987 Ayers ..... 273/153 S

FOREIGN PATENT DOCUMENTS 1117069 10/1984 U.S.S.R. ..... 273/153 S
2116049 9/1983 United Kingdom ..... 273/153 S

*Primary Examiner*—Anton O. Oechsle
*Attorney, Agent, or Firm*—James L. Jackson

[57] ABSTRACT

A manipulative amusement device that includes upper and lower plates parallel to and in coaxial alignment with and rotatable relative to each other, each plate having a pair of spaced collar pieces disposed on opposite sides of a plurality of openings disposed in the periphery thereof to define a plurality of coaxially disposed spaced pairs of collar members, and a plurality of cylinder assemblies each formed about a respective longitudinal axis and comprised of an even number of cylinder segments with each cylinder assembly having opposing ends adapted for being rotatably received by the pair of spaced coaxially aligned collar members for permitting rotation of the cylinder assemblies. Improvements include a knob portion having a generally cylindrical inner recess projecting axially from one plate with the other plate having an axial post projecting therefrom and adapted for insertion through a central aperture in the one plate and into the knob recess, and a spring loaded retainer assembly cooperating with the post and the interior recess of the knob member for biasing both plates into planar surface contact and permitting limited axial separation of the plates in response to outward forces exerted therebetween by lugs disposed in the periphery of the collar members rotating out of registry with longitudinal recesses disposed in the ends of the cylinder assemblies.

11 Claims, 3 Drawing Sheets

MANIPULATIVE AMUSEMENT DEVICE

FIELD OF THE INVENTION

This invention relates to amusement devices and, more particularly, relates to improvements in a manipulative geometric spacial puzzle or the like.

BACKGROUND OF THE INVENTION

Spacially manipulative amusement devices have long been known in the art which provide a plurality of individual components which define various preselected geometrical shapes, surface configurations, or the like. A familiar example of this may be seen in the device sold under the registered trademark RUBIK'S CUBE, a representative example of which is disclosed in Erno Rubic U.S. Pat. No. 4,378,116 and entitled "Spatialogical Toy". Yet another such example may be further seen depicted in Wayne Butler United Kingdom patent application Ser. No. GB2116049A entitled "Manipulative Puzzle". Still another example is the amusement device disclosed in David Butler U.S. Pat. No. 4,708,345, issued Nov. 24, 1987 entitled "Manipulative Amusement Device."

In the puzzle disclosed in the latter patent, upper and lower parallel plates are rotatable in parallel planes about a vertical axis. A plurality of cylinder assemblies is carried by the plates and disposed on the outer periphery such that their longitudinal axes intersect to define a regular polygon parallel to the plates. Means are provided for maintaining spatial position of the upper one-half of each cylinder assembly relative to the upper plate, and the lower one-half of each cylinder assembly relative to the lower plate as the plates are rotated in opposing directions. When the plates are rotated such that the upper and lower cylinder halves combine to define the cylinder assemblies, each such cylinder assembly is further rotatable about its longitudinal axis.

Each cylinder assembly is comprised of discrete sections, each preferably having an identifiable marking on its outer surface such as a different color or the like. Repeated rotation of the plates and cylinder assemblies permits selective formation of the cylinder assemblies from any combination of discrete cylinder sections. When the combinations of cylinder sections are randomized, such repeated rotations may result in forming a preselected pattern of such identifiable markings to solve a puzzle as, for example, in forming a plurality of cylinder assemblies each with a different uniform outer surface color.

In the disclosure of U.S. Pat. No. 4,708,345, each of the discrete cylinder sections carried a hemispherical nub at each end which registered with a mating hemispherical detent in the plate collars carrying the cylinder assemblies. The rotary registration of the upper and lower plates also used a "nub and detent" arrangement which required the plates to spread apart a sufficient amount to allow the nubs to ride up and out of the detents as the plates rotated with respect to each other. The "spread" plates returned to a planar surface face contact condition as the nubs on one plate rotated into the corresponding detents or recesses of the other plate. The "spreading" operation depended solely on the inherent elasticity of the material out of which the plates were constructed. Further, the "nub and detent" arrangement is expensive to manufacture. The molding of the projecting nubs and detent holes requires a complex mold that has a sliding mechanism to release from the "blind" holes for the radially spaced detents and the projecting nubs in order to separate the molded part from the mold.

SUMMARY OF THE INVENTION

In accordance with one principle of the present invention an improved manipulative amusement device is provided, including an upper plate, a lower plate parallel to and in coaxial alignment with the upper plate and rotatable relative thereto, each plate having a common center-point including a plurality of openings on the outer periphery thereof alignable in vertical registry upon relative rotation, each plate further including a pair of spaced collar pieces disposed on opposite sides of each of the plurality of openings which form, when the plate openings are in vertical registry mating pairs of the collar pieces to define a plurality of coaxially disposed spaced pairs of collar members each having a pair of coaxially aligned annular recesses, a plurality of cylinder assemblies each formed about a respective longitudinal axis and comprised of an even number of cylinder segments numbering at least six, and each cylinder assembly having opposing annular end projections for being rotatably received by each one of the pair of annular recesses in one of the pair of spaced coaxially aligned collar members and in coaxial alignment therewith for permitting rotation of each of the cylinder assemblies about the axis of one of the pairs of collar members, the improvement in combination therewith that includes a knob portion having a generally cylindrical interior recess projecting axially outwardly from the upper plate the upper plate further having a central aperture disposed axially thereof and coaxially aligned centrally of the generally cylindrical knob portion, the lower plate having an axial post projecting outwardly from the inner face thereof for registering with and projecting through the central aperture of the upper plate and coaxially within the knob portion, force exerting means cooperating with the post projecting into the interior of the knob portion and the upper plate surface disposed within the knob portion generally cylindrical interior recess for securing the upper plate to the lower plate in rotational relationship thereto and biasing the plates into planar surface contact with each other for forming the pairs of collar members, the force exerting means permitting limited axial separation of the upper and lower plates in response to outward force exerted therebetween. Further, each of the collar members has disposed within the annular recesses a plurality of circumferentially spaced radially projecting lugs, and each of the cylinder assembly annular end projections has a plurality of circumferentially spaced longitudinal recesses registering with the plurality of collar member circumferentially spaced projecting lugs. When the circumferentially spaced lugs and recesses are in registry, the force exerting means biases the upper plate into contact with the lower plate and one-half of the cylinder segments comprising each of the cylinder assemblies is axially aligned within each of the pairs of spaced collar pieces for permitting planar rotation of the upper and lower plates and circumferential displacement of the one-half of the cylinder segments from one plate opening to an adjacent plate opening. When the circumferentially spaced lugs and recesses are out of registry, the lugs contact the circumferential surface of the mating annular end projections and produce an outward force acting between the upper and lower plates against the force exerting means for permitting limited axial separation between the vertically registering collar pieces and facilitating axial rotation of the cylinder assembly.

In accordance with another principle of the invention, the force exerting means includes a retainer member having a generally cylindrical cross-sectional configuration and adapted for coaxial insertion over the portion of the post coaxially projecting into the interior of the knob portion on the upper plate, one end of the retainer member contacting the upper plate surface within the knob portion interior, and the other end of the retainer member terminating below the end of the projecting post, retaining means attached to the end of the projecting post above the other end of the retainer member, and spring means disposed between the retaining means attached to the projecting post and the retaining member for exerting a force therebetween and biasing the upper and lower plates into planar surface contact with each other.

In accordance with still another principle of the invention, the retainer member includes a radially extending annular shoulder portion disposed on one end of the retainer member, and a compressible coil spring adapted for coaxial insertion over the cylindrical retainer member and having one end in contact with the radially extending annular shoulder and the other end in contact with the retaining means.

In accordance with yet another principle of the invention, the improved manipulative amusement device further includes a plurality of radially disposed annularly spaced raised nubs or lugs disposed on the upper plate surface within the knob portion generally cylindrical interior recess, and wherein the projecting post includes a longitudinal slot therein, the retainer member includes an internal radially projecting key adapted for mating with the slot in the projecting post for prohibiting relative movement therebetween, and the retainer member annular shoulder portion includes a plurality of coaxially depending serrated teeth disposed about the periphery thereof for contacting the annularly spaced raised lugs for creating a rachet-like noise when the upper plate is rotated relative to the lower plate.

BRIEF DESCRIPTION OF THE DRAWINGS

The above features and principles of the invention are disclosed in the accompanying drawings, which drawings form a part of this specification.

In the drawings.

DETAILED DESCRIPTION OF THE INVENTION

Figure 1:
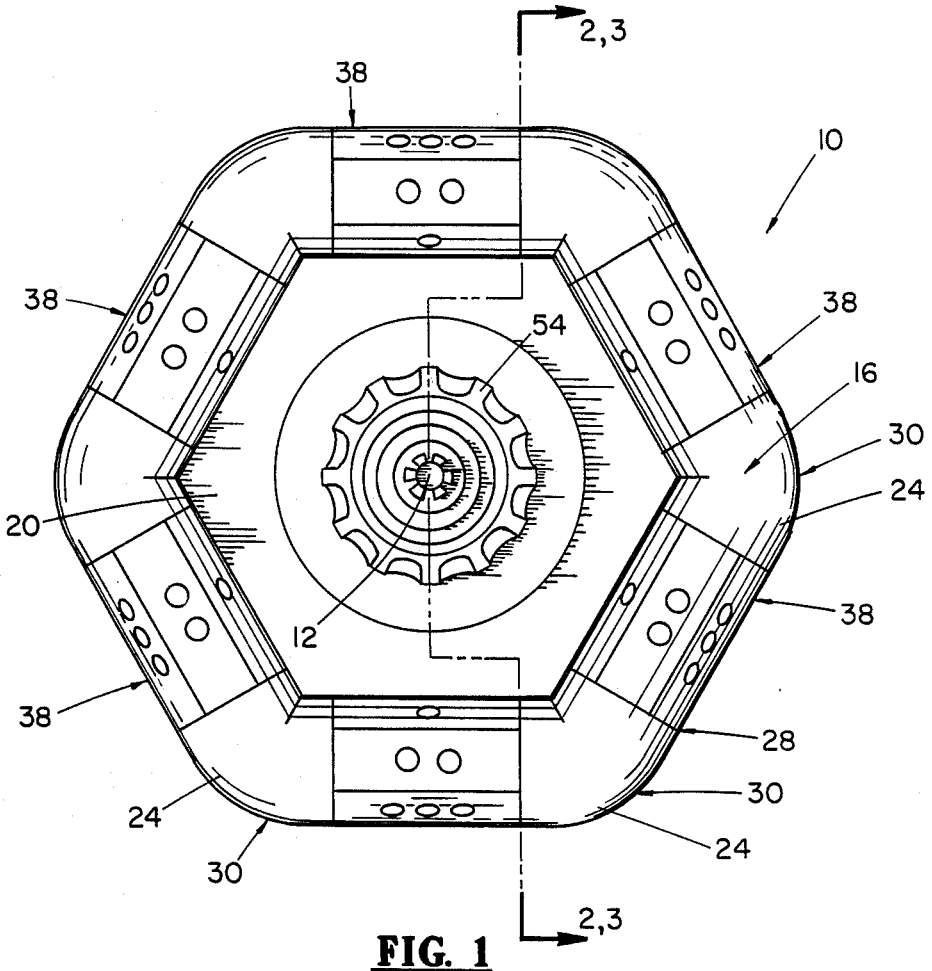
FIG. 1 is a top plan view of the preferred embodiment of the improved manipulative amusement device.

Referring to FIGS. 1, 2, 3, and 4 there will be seen depicted therein generally a preferred embodiment of an improved manipulative amusement device 10 of the present invention. The device may be seen to be generally symmetrical about a central vertical axis 12 and is generally comprised of an upper and lower assembly 16 and 18, respectively, lying respectively above and below a horizontal plane 14 perpendicular to the axis 12. The upper assembly 16 includes an upper plate 20, while the lower assembly 18 includes a lower plate 22. The upper plate 20 and lower plate 22 in assembly will be generally disposed parallel to one another. Each plate 20 and 22 will have disposed on the outer periphery thereof a plurality of semi-cylindrically shaped collar portions forming a plurality of collar pieces or portions 24 and 26, respectively. When the upper and lower plates 20 and 22 are aligned about the axis 12 so as to bring the respective half-cylinder sections 24 and 26 into vertical alignment with one another, the vertically registering collar pieces 24 and 26 form a plurality of cylindrical collar members 30.

Each upper and lower plate 20 and 22 has a plurality of rectangularly shaped openings 28 disposed in the outer edges thereof when viewed from above and below. With respect to the upper plate 20, on either end of each opening 28, an upper collar piece 24 in the shape of the abovedescribed half-cylinder is provided. In like manner, with respect to the lower plate 22, on either end of the openings 28 therein, a lower collar piece 26, also in the shape of the above-described half cylinder, will also be provided. When such upper and lower collar pieces 24 and 26 are aligned in vertical registry, the previously described collar members 30 are thereby formed.

Figure 5:
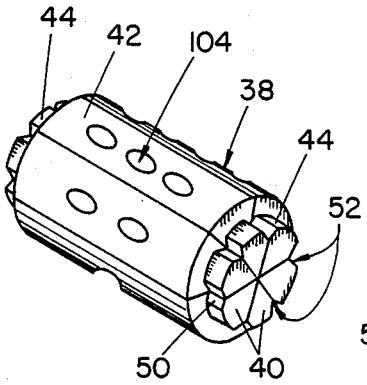
FIG. 5 is a perspective view of a cylinder assembly according to the present invention.
Figure 6:
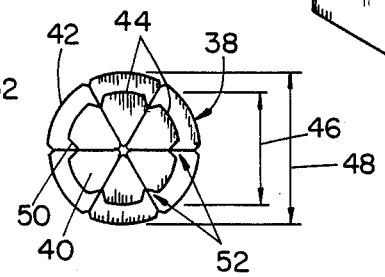
FIG. 6 is an end view of the cylinder assembly shown in FIG. 5.
Figure 7:
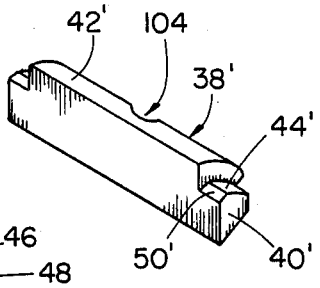
FIG. 7 is a perspective view of one of the cylinder segments comprising the cylinder assembly shown in FIGS. 5 and 6.

It will be noted that with respect to each collar member 30, at either end of the cylindrical shape thereby formed, respective first and second annular recesses 34 and 36 are formed therein, each for receiving a respective annular projecting end 44 of one of the assemblies depicted in FIGS. 5, 6 and 7. Referring more particularly to the cylinder assemblies 38, the cylinder assemblies 38 will be seen to include generally annular projecting ends or shoulders 44 disposed at either end thereof for abuttingly engaging the annular recesses 34 and 36 of each collar member 30. Accordingly, it will be noted that the annular projecting shoulders 44 will have a diameter 46 substantially equal to the diameter of the first and second recesses 34 and 36. The outer cylindrical surfaces 42 will, in like manner, define a larger diameter 48 generally of the same diameter as the outer diameter of collar members 30.

Each cylinder assembly 38 is comprised of a plurality of identical cylinder sections 38', a representative one of which may be seen illustrated in FIG. 7. With respect to each such section 38', a shoulder portion 44' is provided on each end including a wedge-shaped end face 40'. The wedge-shaped cylinder section 38' may be solid as shown, or it may have a hollow interior in order to make the cylinders 38 lighter and trim the molding cost of the individual sections. In addition, the longitudinal edges of each cylinder section annular shoulder 44' are chamfered as shown at 50. When the cylinder sections 38' are assembled to form the cylinder assembly 38, comprising at least six such sections (see FIG. 5), the adjacent chamfers 50 form longitudinal recesses 52 along the outer periphery of the annular projecting shoulder 44. The utility of the longitudinal recesses 52 will be described in greater detail later.

Referring back to FIGS. 1, 2, 3 and 4, the upper plate 20 may preferably have disposed thereupon a projecting knob portion 54 coaxially aligned with the central axis 12 and integrally formed with the upper plate 20. The knob portion 54 will have a cross-section defining a generally cylindrical interior recess 56, and a central axially disposed aperture 58 through plate 20. The lower plate 22 includes a projecting post 60 for coaxial insertion through aperture 58 into the interior 56 of the knob portion 54. More particularly, the post 60 will project axially along the vertical axis 12 and in coaxial alignment therewith and includes an end 62 and shoulder 64. The upper and lower plates 20 and 22 may be brought together along axis 12, with the plates brought into radial mating engagement with the end 62 of post 60 disposed within the generally cylindrical recess 56 of the knob portion 54. Coaxially disposed within the knob recess 56 and mounted on the post 60 is a force exerting means 63, the construction and function of which will hereafter be described in greater detail.

A cylindrical retainer member or sleeve 66 is disposed coaxially about the projecting post 60 within the knob recess 56. The post 60 has disposed therein a longitudinal slot 68 for accommodating an internal key or tab 70 radially projecting from the inner surfaces of the retainer member 66. The engagement of the retainer member key 70 within the longitudinal slot 68 in the post 60 prevents relative movement between the retainer member 66 and the lower plate projecting post 60. The lower end of retainer member 66 includes a radially projecting annular shoulder portion 72. The shoulder portion 72 has a plurality of serrated teeth 74 coaxially depending from its periphery and contacting the surface 80 of the plate within the generally cylindrical recess 56 of the knob portion 54. In addition, the surface 80 includes a plurality of raised nubs or projecting lugs 76 radially disposed and annularly spaced about the axis 12 and in contact with the serrated teeth 74 projecting from the retainer member 66 for purposes to be hereinafter further described.

Attached adjacent to the end 62 of post 60 is one embodiment of a retaining means 77 comprising a washer 78 engaging the post shoulder 64 and a retaining ring 79. Disposed between the washer 78 and the projecting shoulder 72 of the retainer member 66 is a spring means 81. The spring means 81 may conveniently be a coil spring adapted for coaxial insertion over the cylindrical retainer member 66 with one end in contact with the washer 78 and the other end in contact with the projecting annular shoulder 72 for exerting a force therebetween for biasing the upper and lower plates, 20 and 22, into planar surface contact with each other. As may best be seen FIG. 2, the post shoulder 64 carrying washer 78 extends beyond the end of the cylindrical retainer member 66 a distance shown at 100. This distance 100 is the maximum distance or interval that plate 20 can move or yield with respect to plate 22 against the biasing action of spring 81 before the extending end of member 66 engages washer 78 as a stop. The recess 56 and the projecting end of knob portion 54 may be conveniently closed by a cap 55 that may be press fit into place in rim 57. A label (not shown) may be placed on the exterior of cap 55 to display the brand name and/or other information regarding the device.

Figure 2:
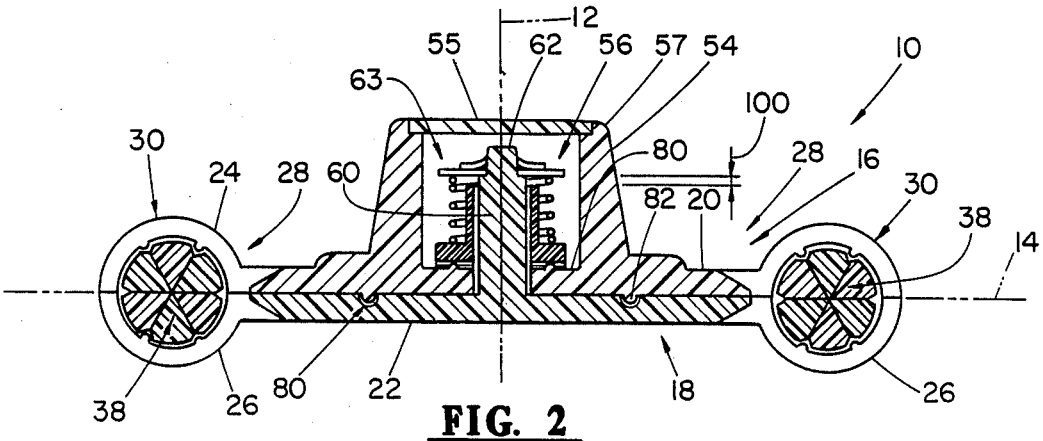
FIG. 2 is a vertical cross-sectional view of the improved device taken along lines 2—2 of FIG. 1.
Figure 3:
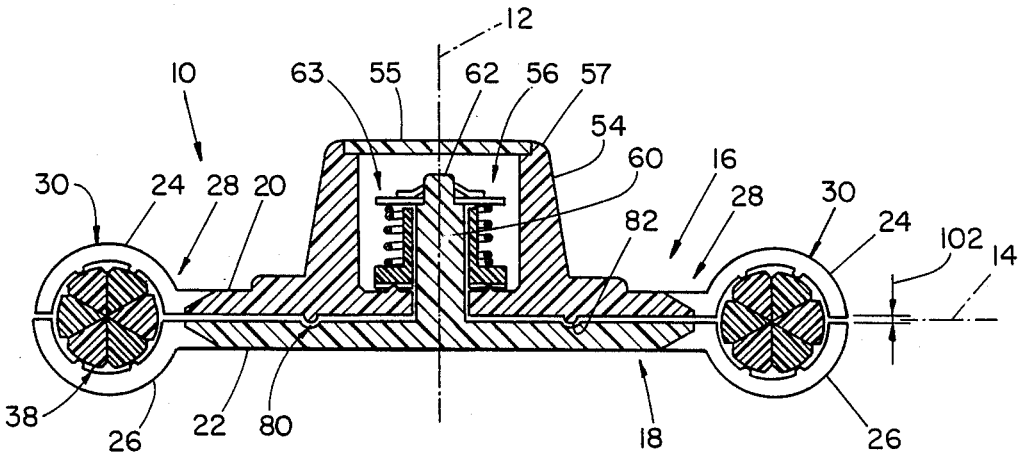
FIG. 3 is a vertical cross-sectional view of the improved device taken along lines 3—3 of FIG. 1.

Referring now to FIGS. 2 and 3, the lower plate 22 has disposed raially about the post 60 an annularly spaced plurality of recessed indentions 80 disposed in the face of the lower plate 22. A plurality of projecting nubs or lugs 82 are radially disposed and annularly spaced about aperture 58 on the lower surface of the upper plate 20. The radial distances of recesses 80 and nubs or lugs 82 from axis 12 are coincident, and relative rotation between the upper and lower plates 20 and 22 about the axis 12 will cause the nubs or lugs 82 to successively contact each of the plurality of recesses 80 for providing a positive stop location and a tactile indication that the respective peripheral openings 28 are in registering alignment.

The interior of each of the collar member recesses 34 and 36 are defined by a pair of semi-cylindrical surfaces 84 and 86 and an end wall 85. A plurality (two when the number of cylinder sections defining a cylinder assembly are six) of circumferentially spaced projecting nubs or lugs 88 and 90 are disposed on the above-described semi-cylindrical surfaces 84-86, respectively. When the cylinder assemblies 38 are formed and the opposite annular projecting ends 44 are inserted into the opposing collar member recesses 34 and 36 as hereinabove described, and with the nubs or lugs 88 and 90 engaging the chamfered longitudinal recesses 52, one-half of the cylinder sections 38' will lie above the horizontal plane 14 and the other one-half of the cylinder sections 38' will lie below the horizontal plane as shown in FIG. 2. The engagement of the nubs or lugs 88 and 90 with the cylinder assembly longitudinal recesses 52 provides a positive stop and tactile indication that the cylinder assembly 38 is properly oriented to permit rotation of the upper plate assembly 16 with respect to the lower plate assembly 18 for peripherally rotating one-half of the cylinder sections 38' from one plate opening 28 to an adjacent opening 28 for reregistering the rotated cylinder sections 38' with another one-half of the cylinder sections 38' already in the adjacent opening.

However, when a cylinder assembly 38 is rotated about its longitudinal axis (see FIG. 3) the recesses 52 are rotated out of mating registry with the projecting nubs or lugs 88 and 90, and the projecting tip surfaces of the nubs or lugs ride up on the annular surface of the shoulder 44, applying aa outwardly directed force between the cylinder assembly 38 and the collar pieces 24 and 26. The force exerted by the cylinder assembly 38 on the adjacent collar pieces 24 and 26 is translated to the respective upper and lower plates 20 and 22, respectively, and applied against the biasing force of the spring means 81 as hereinabove described. The spring 81 permits the upper plate 20 to yield with respect to the lower plate 22 until the upper end of the retainer member 66 engages the retaining means 78, 79 (see FIGS. 2 and 3), thus permitting limited separation of the plates as shown at 102 in FIG. 3. The maximum interval of the distance 102 is equal to or less than the interval 100 previously described. The yielding of the upper plate 20 with respect to the lower plate 22 facilitates the rotation of the cylinder assemblies 38, but the spring biasing force of the spring means 81 provides a positive "locking" indication that the cylinder assembly 38 has been rotated into a proper position to facilitate relative rotation of the plate assemblies 16 and 18 as previously described. Similarly, the rotation of plate 20 with respect to plate 22 will cause the nubs or lugs 82 to ride out of and disengage from the recesses 80 and exert an outward "spreading" or "separating" force between plates 20 and 22, similar to the force above described with respect to the rotating cylinder assemblies 38. In addition, the spring biasing force of the spring means 81 also provides a positive "locking" and tactile indication that the plate nubs 82 have again engaged the detents or recesses 80 to provide proper indexing of the generally rectangular plate apertures 28 for permitting axial rotation of the respective cylinder assemblies 38.

The cylinder sections 38' may be of differing colors, and they may also carry a visual and tactile indicator 104 that may comprise a preselected number of indentions that may equal in number from "one" to "six" for a six-section cylinder assembly 38.

Figure 10:
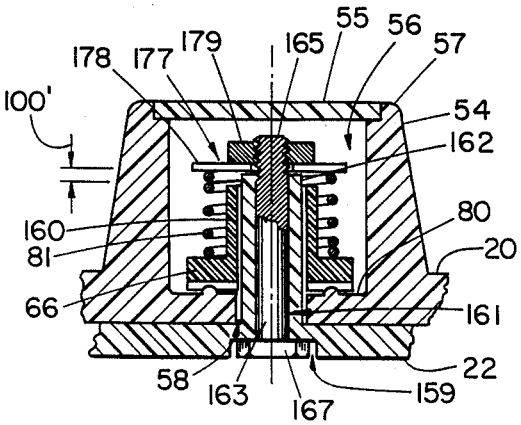
FIG. 10 is a fragmentary vertical cross-sectional view of the post-knob portion of the improved device shown in FIG. 1, showing a second embodiment of the retaining means.

A second embodiment of the retaining means 177 is shown in FIG. 10. Post 160 is integrally attached to lower plate 22 and projects upwardly through aperture 58 in plate 20 and coaxially within the projecting knob portion 54, closed by cap 55. However, post 160 has an axial hole 161 formed therethrough for accommodating a bolt 163 that has a projecting end 165 within the interior 56 of the knob portion and a head 167 disposed in coaxial recess 159 formed in the outer face of plate 22. The head 167 cooperates with the complementary shape of the recess 159 for preventing relative rotational motion of the bolt 163 with respect to the lower plate 22 and post 160. A nut 179 is threadably attached to the projecting end of the bolt 163. A plate in the form of stamped member 178 having an aperture centrally therethrough is disposed over the bolt 163 below the nut 179 and in contact with the projecting end 162 of the post 160. As may be seen, the projecting bolt end 165, the nut 179 and the stamping 178 form the retaining means 177 of this second embodiment, with the member 178 engaging said one end of the spring means 81 as hereinabove described in the first embodiment. As may be seen in FIG. 10, the projecting post end 162 extends beyond the end of the cylindrical retainer member 66 a distance shown as 100', equivalent to the distance 100 herein above described in the previous embodiment which permits the axial "spread" 102 between plates 20 and 22 for the identical purposes as hereinabove described.

Figure 11:
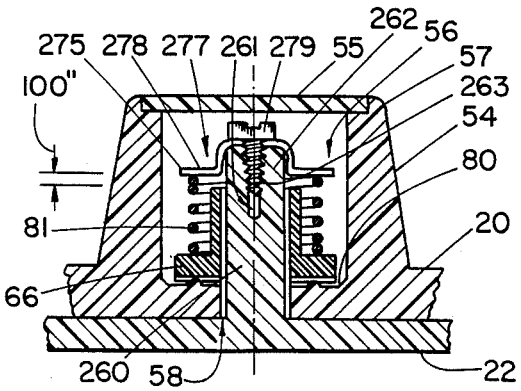
FIG. 11 is a fragmentary vertical cross-sectional view of the post-knob portion of the improved device shown in FIG. 1, showing a third embodiment of the retaining means.
Figure 4:
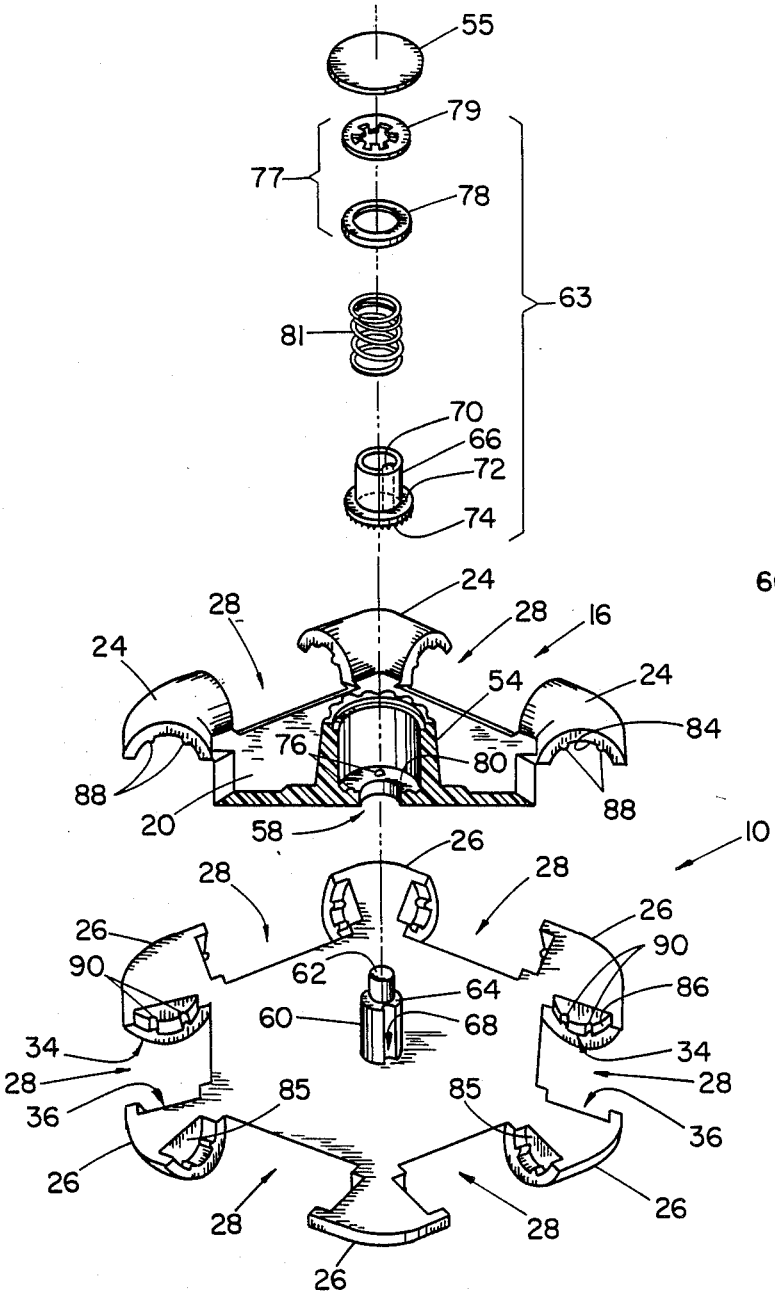
FIG. 4 is a partial perspective exploded view partly in cross-section, of the improved device shown in FIG. 1.
Figure 8:
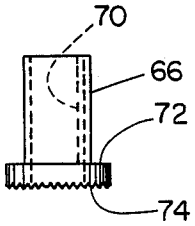
FIG. 8 is a side elevation view of the cylindrical retainer member.
Figure 9:
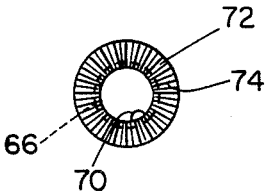
FIG. 9 is a bottom plan view of the lower end of the cylindrical retainer member shown in FIG. 8.

Referring to FIG. 11, a third embodiment of the retaining means 277 is shown. Post 260 is integrally attached to lower plate 22 and projects upwardly through aperture 58 in plate 20 and coaxially within the projecting knob portion 54 and closed by cap 55. Post 260 has a pilot hole 261 drilled into its extending end 262 for accommodating a self-tapping screw 263 having a head 279. Disposed between the screw head 279 and the post end 262 is a bell-shaped member 278 having a radially extending annularly disposed flanged rim 275. The screw 263, screw head 279 and bell-shaped member 278 form the retaining means 277 of this third embodiment, with the flanged rim 275 of the bell-shaped member engaging said one end of the spring means 81 as hereinabove described in the first embodiment. The relationship between the post end 262 and the depth of the bell-shaped member 278 determines the interval or distance that separates the end of the cylindrical retainer member 66 and the annular flanged rim 275 of the bell-shaped member 278. This interval or distance is shown as 100'', equivalent to the distance 100 hereinabove described in the first embodiment which permits the axial "spread" 102 between plates 20 and 22 for the same reasons as perviously described.

Several variations on the aforementioned disclosure are possible and, accordingly, the invention is not intended to be so limited to the particular applications and embodiments herein depicted. For example, in the embodiment of FIG. 1, when the upper and lower plates 20 and 22 are aligned as illustrated herein, six cylindar assemblies 38 are thereby formed, each being comprised, in turn, of six sections 38'. Moreover, each cylinder assembly 38 is thereby positioned so as to define a regular polygon which, in this application, is a hexagon. However, either alone or in combination, it will be readily apparent that the cylinder assemblies 38 may be fashioned of a different number of sections as desired, lending to increased flexibility and complexity of the possible games. Still further greater or fewer numbers of such cylinder assemblies 38 may be provided resulting in a polygon having sides other than the six described and depicted herein. Similarily, the number of cylinder sections 38' may be increased as long as the number is even.

It is therefore apparent that the present invention is one well adapted to obtain all of the advantages and features hereinabove set forth, together with other advantages which will become obvious and apparent from a description of the apparatus itself, It will be understood that certain combinations and subcombinations are of utility and may be employed without reference to other features and subcombinations. Moreover, the foregoing disclosure and description of the invention is only illustrative and explanatory thereof, and the invention admits of various changes in size, shape and material composition of its components, as well as in the details of the illustrated construction, without departing from the scope and spirit thereof.

I claim:

1. In a manipulative amusement device including an upper plate and lower plate parallel to and in coaxial alignment with the upper plate and rotatable relative to said upper plate, each plate having a common centerpoint and including a plurality of openings on the outer periphery thereof alignable in vertical registry upon relative rotation, each plate further including a pair of spaced collar pieces disposed on opposite sides of of each of said plurality of openings which when said plate openings are in vertical registry mating pairs of said collar pieces define a plurality of coaxially disposed spaced pairs of collar members each having a pair of coaxially aligned recesses, a plurality of cylinder assemblies each formed about a respective longitudinal axis and comprised of an even number of cylinder segments numbering at least six, and each said cylinder assembly having opposing annular end projections for being rotatably received by each said pair of annular recesses in one of said pair of spaced coaxially aligned collar members and in coaxial alignment therewith for permitting rotation of each of said cylinder assemblies about said axis of one of said pairs of collar members the improvement in combination therewith, comprising a knob portion having an inner generally cylindrical recess projecting axially outwardly from said upper plate, said upper plate further having a central aperture disposed axially thereof and coaxially aligned within in said generally cylindrical knob portion, said lower plate having an axial post projecting outwardly from the inner face thereof for registering with and projecting through said upper plate central aperture and coaxially into said knob portion generally cylindrical recess, force exerting means cooperating with said lower plate projecting post and the interior of said upper plate knob portion generally cylindrical recess for securing said upper plate to said lower plate in rotational relationship thereto and biasing said upper plate into radial contact with said lower plate for forming said pairs of cylinder members, said force exerting means permitting limited axial separation of said upper and lower plates in response to outward forces exerted therebetween, each of said collar members having disposed within said annular recesses a plurality of circumferentially-spaced longitudinally disposed projecting lugs, and each of said cylinder assembly annular end projections having a plurality of circumferentially-spaced longitudinally disposed recesses registering with said plurality of collar member circumferentially-spaced projecting lugs, wherein when said circumferentially-spaced lugs and recesses are in registry said force exerting means biases said upper plate into contact with said lower plate and one half of said cylinder segments comprising each said cylinder assembly is axially aligned within each of said pairs of spaced collar pieces for permitting planar rotation of said upper and lower plates and said circumferential displacement of said one half of said cylinder segments from one plate opening to an adjacent plate opening, wherein when said circumferentially-spaced lugs and recesses are out of registry said lugs ride out of said recesses and contact the circumferential surface of said annular end projections to produce an outward force acting between said upper and lower plates against said force exerting means for permitting limited axial separation between said vertically registering collar pieces and said pair of plates for facilitating axial rotation of each said cylinder assembly.

2. The improved manipulative device as described in claim 1, wherein said force exterting means comprises a retainer member having a generally cylindrical cross-sectional configuration and adapted for coaxial insertion over said portion of said post coaxially projecting into said knob portion generally cylindrical interior recess, one end of said retainer member contacting said upper plate surface disposed within said knob portion interior recess and the other end of said retainer member terminating below the projecting end of said post, retaining means attached to said post above said other end of said retainer member, and spring means disposed between said retaining means attached to said projecting post and said retainer member for exerting a force therebetween and biasing said upper and lower plates into planar surface contact with each other.

3. The improved manipulative device as described in claim 2, wherein said retainer member includes a radially extending annular shoulder portion disposed on said retainer member one end, and said spring means comprises a compressible coil spring adapted for coaxial insertion over said cylindrical retainer member with one end in contact with said radially extending annular shoulder and the other end in contact with said retaining means.

4. The improved manipulative device as described in claim 3, wherein said retaining means comprises a retaining member disposed above said other end of said retainer member and adapted for attachment to the projecting end of said post, said member contacting and securing the other end of said coil spring, and fastening means for attaching said retaining member to said post.

5. The improved manipulative device as described in claim 4, wherein said retaining member is an annular washer adapted for coaxial insertion over said projecting post end, said projecting post has an annular projecting shoulder disposed thereon above the other end of said retainer member for engaging and maintaining said washer above said other end of said retainer member, and said fastening means is a friction retainer ring adapted for coaxial insertion over said projecting post end in contact with said washer for frictionally engaging said post to secure said washer in contact with said shoulder.

6. The improved manipulative device as described in claim 5, wherein the distance between the edge of said retainer member other end and said washer engaging said post shoulder defines the maximum axial separation that can occur between said upper and lower plates.

7. The improved manipulative device as described in claim 3, wherein said projecting post includes a coaxial aperture disposed therethrough including communicating with the outer surface of said lower plate, and wherein said retaining means comprises a threaded bolt disposed through said coaxial aperture in said post and having its free end projecting above the projecting end of said post, a retaining member having a central aperture therethrough adapted for insertion over said free end of said threaded bolt and in contact with the projecting end of said post for contacting and securing the other end of said coil spring, and threaded attachment means for cooperating with said free end of said bolt to secure said retaining member in contact with the projecting end of said post.

8. The improved manipulative device as described in claim 7, wherein the projecting end of said post supporting said retaining plate projects above the other end of said retainer member, and wherein the distance between the edge of said retainer member other end and said retaining member engaging the projecting end of said post defines the maximum axial separation that can occur between said upper and lower plates.

9. The manipulative device as described in claim 3, wherein said projecting post includes a coaxial aperture disposed partially therethrough and communicating with the projecting end thereof, and wherein said retaining means comprises a retaining plate having a central aperture therethrough and adapted for seating contact with the projecting end of said post with said central aperture in coaxial alignment with said aperture disposed in the projecting end of said post for contacting and securing the other end of said coil spring, and a self-tapping threaded fastener for insertion through said retaining plate aperture into said post aperture for theadably engaging the projecting end of said post and securing said retaining plate to the projecting end of said post.

10. The improved manipulative device as described in claim 9, wherein the distance between the edge of said retainer member other end and said retaining plate portion engaging said coil spring defines the maximum axial separation that can occur between said upper and lower plates.

11. The improved manipulative device as described in claim 3, further comprising a plurality of radially disposed annularly-spaced raised nubs disposed on the upper plate surface within said knob portion generally cylindrical recess, and wherein said lower plate projecting post includes a longitudinal slot disposed therein, said retainer member includes an internal radially projecting key adapted for mating with said longitudinal slot in said projecting post for prohibiting relative movement therebetween, and wherein said retainer member annular shoulder portion includes a plurality of depending serrated teeth disposed about the periphery of said annular shoulder for contacting said annularly spaced raised nubs for creating a rachet-like noise when the upper plate is rotated relative to the lower plate.

* * * * *